US006445970B1

(12) United States Patent
Hedman et al.

(10) Patent No.: US 6,445,970 B1
(45) Date of Patent: Sep. 3, 2002

(54) COMPUTERIZED EMBROIDERY MACHINE DIAGNOSTICS

(75) Inventors: Dale R. Hedman, Littleton; Robert Bruce Ton, Arvada; Jeffrey T. Block, Westminster; Dean Gerald Pearson, Arvada; Peter Kern, Westminster, all of CO (US)

(73) Assignee: Melco Industries, Inc., Denver, CO (US)

( * ) Notice: Subject to any disclaimer, the term of this patent is extended or adjusted under 35 U.S.C. 154(b) by 0 days.

(21) Appl. No.: 09/506,197

(22) Filed: Feb. 17, 2000

(51) Int. Cl.[7] ..... G06F 19/00; D05B 19/12; D05B 21/00; D05B 5/02

(52) U.S. Cl. ..... 700/138; 112/445; 112/475.19

(58) Field of Search ..... 700/138, 136, 700/137; 112/102.5, 470.06, 475.19, 470.01, 445, 275, 277

(56) References Cited

U.S. PATENT DOCUMENTS 4,221,176 A * 9/1980 Besore et al. ..... 112/102.5
4,867,088 A 9/1989 Hyodo et al. ..... 112/453
5,029,538 A 7/1991 Gäumann et al. ..... 112/121.11
5,657,708 A 8/1997 Okuno et al. ..... 112/102.5
5,662,055 A 9/1997 Hartwig et al. ..... 112/102.5
5,899,153 A 5/1999 Hausammann et al. .. 112/102.5
5,953,226 A 9/1999 Mellish et al. ..... 364/147
5,964,168 A 10/1999 Komuro ..... 112/102.5
5,970,430 A 10/1999 Burns et al. ..... 702/122
5,996,518 A * 12/1999 Tomita ..... 112/470.01
6,032,595 A * 5/2000 Okuyama ..... 112/102.5
6,311,097 B2 * 10/2001 Kwak ..... 700/138

* cited by examiner

*Primary Examiner*—Peter Nerbun
(74) *Attorney, Agent, or Firm*—Sheridan Ross P.C.

(57) ABSTRACT

Automatic testing and diagnosing a computerized stitching machine of a stitching system is provided. The system includes one or more programs that test operation of stitching machine components and generate specific error or status messages related to such components. Control panel software can be invoked to allow viewing of detailed status information for various components and the operation of specific components individually. Networking software can be enabled to allow this information to be viewed using a screen display and controlled from a location remote from the site of the stitching machine.

23 Claims, 6 Drawing Sheets

COMPUTERIZED EMBROIDERY MACHINE DIAGNOSTICS

FIELD OF THE INVENTION

The present invention relates to stitching machines and more specifically to status and diagnostic programs for use with computerized embroidery machines.

BACKGROUND OF THE INVENTION

Present day embroidering is commonly done using computerized embroidering machines, which are utilized in stitching patterns, such as letters that spell out words and/or designs on a variety of objects including t-shirts, caps and other cloth materials. These machines provide several advantages, including speed and repeatability, which are useful in both high volume and custom embroidering settings. These machines can have several embroidery heads and are capable of embroidering in several different colors, which are changed and trimmed automatically. The machines traditionally have a rack which is moved beneath the embroidery heads during stitching to create a pattern on the fabric being embroidered. A computerized embroidery machine might experience an electrical malfunction such as a computer controller error, or a mechanical malfunction such as an obstruction which can prevent a part from moving properly.

In order to troubleshoot a malfunction according to prior art procedures, a technician has to inspect the embroidery machine, determine the cause of the malfunction, and then correct the problem. Given the mechanical and electronic complexity of these machines, such procedures can take a significant amount of time, which can create a large expense due to the cost of having the technician service the machine and the loss of productivity while the machine is not in operation. Additionally, the technician is often not on the customer site, such that if there is a malfunction in the machine, the customer will have to wait for the technician to arrive before the problem can be fixed, adding to the loss of productivity of the machine.

Accordingly, there is a need for automatic embroidery machine diagnostics which would allow a technician to perform one or more tests and receive error or status codes from the machine, thus narrowing down the possible root cause of the problem and allowing the repair or other solution to be accomplished in less time.

SUMMARY OF THE INVENTION

The present invention provides largely automatic procedures for determining component status and conducting diagnostics on a computerized embroidery machine. It should be appreciated, however, that these features can be implemented or associated with stitching machines other than embroidery machines, such as computerized sewing machines.

To perform these functions, a software program which performs several automated steps to verify operability of various components within a computerized embroidery machine and generate status or error messages is provided. Consequently, the present invention addresses the noted deficiencies of manually troubleshooting a stitching machine, i.e., the large amount of time manual troubleshooting can consume and the associated down-time of the stitching machine.

The status and diagnostic program of the present invention also addresses the noted issues by generating specific status or error messages, which may help narrow the potential source of the problem and thus reduce the amount of time needed to find and correct the problem. For example, if the needle is not moving up and down properly due to an obstruction, one embodiment of the present invention will generate an error message to notify a technician that the needle motor is binding, thus immediately focusing attention on that motor.

The present invention also provides control panel software which displays specific information regarding the status of various components and allows for control of some individual components. This control panel software may thus further reduce the amount of time and effort needed to resolve a problem by conveying detailed information on these specific components.

Further, in one embodiment, the status and diagnostic and the control panel software may be operated remotely, i.e. the stitching machine being located at one site and the diagnostic testing being controlled at a central site which is remote from the site of the embroidery machine. The remote communications can be accomplished through the Internet or one or more other communications network, such as a computer/modem hook-up between each site. This remote capability may further reduce the amount of time required to diagnose and correct a problem associated with the stitching machine.

Additional advantages of the present invention can be readily understood from the following description, particularly when taken together with the accompanying drawings.

DETAILED DESCRIPTION

Figure 1:
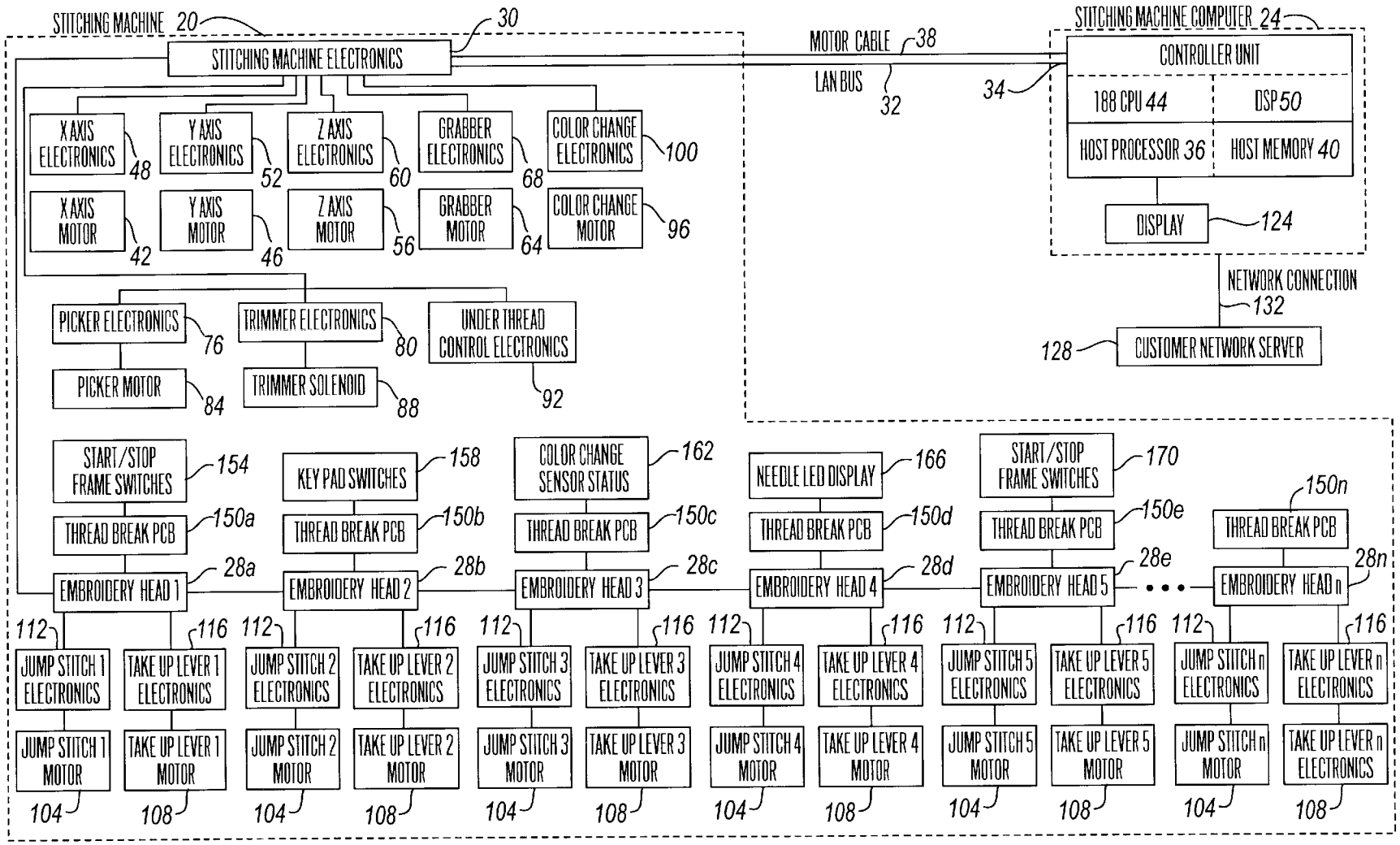
FIG. 1 is a block diagram of a computerized stitching machine showing sub-systems or components of the stitching machine.

While this invention is susceptible of embodiments in many different forms, there is shown in the drawings and will herein be described in detail, preferred embodiments of the invention with the understanding that the present disclosure is to be considered as being exemplary of the principles of the invention and is not intended to limit the broad aspects of the invention to the embodiments illustrated.

Referring to FIG. 1, a block diagram of a computerized embroidery or other stitching machine system is shown. The stitching machine system includes a stitching machine 20 and a stitching machine computer 24. The stitching machine 20 has several components including multiple embroidery heads 28, a rack which can hold a hoop member and into which material to be embroidered can be placed, and the electronics to operate the machine. Electronics in the stitching machine 20 are controlled through the stitching machine electronics 30 which communicate with a controller unit 34 located within the stitching machine computer 24 via a network bus 32 and a motor cable 38. In one embodiment, the network bus 32 is a CAN(controller area network) bus that is used in communicating software-based commands between the stitching machine 20 and the stitching machine computer 24. These commands are used in controlling the different nodes or components of the stitching machine 20. The motor cable 38 carries pulse width modulation (PWM) electrical signals used in controlling the numerous motors of the stitching machine 20.

The stitching machine controller unit 34 can include a host computer, such as a common PC with processor 36 and memory 40. The stitching machine controller unit 34 has a printed circuit board containing a 188 CPU 44 and a DSP 50. The stitching machine controller unit 34 communicates with the various control and operations-related electronics of the stitching machine 20 through the stitching machine electronics 30. The electronics 30 are configured by the controller unit 34 to communicate with the controller unit 34 as a bed node. The electronics 30 are also configured to pass through communications and commands between the controller unit 34 and the embroidery heads 28 as well as the motors which control the movement of the rack (x and y axis movement) and the timing of the needle (z axis movement) as it moves up and down.

In the context of conducting or preparing to conduct an embroidery operation, an application file is downloaded by the host computer to the CPU 44. The application file constitutes the application program that controls the operation of the stitching machine 20. The application file can be downloaded by the host computer from its memory 40 to the CPU 44. The embroidery operation also requires a design or pattern to be stitched. A design file constituting the design is also downloaded by the host computer to the CPU 44. The CPU 44 controls operation of the DSP 50 in conjunction with regulating operations of the stitching machine motors. Overall control of the CPU 44 is the responsibility of control panel software, which resides with the stitching machine controller unit 34. In particular, the control panel software oversees execution of the application file and directs the CPU 44 in its functioning based on the contents of the application file.

With respect to stitching machine components and operations associated therewith, the rack can be moved along an x-axis and a y-axis by turning an x-axis motor 42 and a y-axis motor 46, which are controlled by x-axis electronics 48 and y-axis electronics 52, respectively. Both the x-axis motor 42 and the y-axis motor 46 are equipped with encoders, which enable the x-axis electronics 48 and y-axis electronics 52 to monitor the movement of the motors, and thus monitor the x-y position of the rack. Additionally, each motor has a home flag which triggers a zero or starting position for each motor. There is a needle within each embroidery head 28 which moves up and down through the fabric thus creating stitches on the fabric. This needle is actuated by the z-axis motor 56, which is controlled by the z-axis electronics 60. Like the x-axis motor 42 and the y-axis motor 46, the z-axis motor 56 is also equipped with encoders and a home flag which serve the same purpose as described for the x and y-axis motors. The x-axis electronics 48, y-axis electronics 52 and z-axis electronics 60 are controlled by the controller unit 34 which sends commands to the respective motor electronics through the electronics 30. Additionally, the x-axis electronics 42, y-axis electronics 46, and z-axis electronics 56 also monitor the electric current being drawn by each motor and can set a motor driver fault flag in the event of a current being outside of a preset range.

The grabber motor 64 and grabber electronics 68 operate in the same way as described above for the x, y, and z axis motors and electronics and are controlled by the controller unit 34 through the electronics 30. When the design that is being embroidered into the fabric requires a different color thread to be used, or the embroidering needs to be stopped to go to a different design area, or there is a trim command in the design, thread that is currently being used must be picked, grabbed and cut. In each such case, the electronics 30 functions to control grabber electronics 68, picker electronics 76 and trimmer electronics 80, which in turn control a grabber motor 64, a picker motor 84 and a trimmer solenoid 88. Relatedly, a grabber, that is actuated by the grabber motor 64 also functions during the operation of the trimmer electronics. Specifically, during the thread trimming operation, when the needle is stationary and in the up position, the grabber is controlled using the grabber motor 64 to engage the thread. Additionally, the electronics 30 also control the under thread control electronics 92, which serve to detect the presence or absence of thread as the needle moves up and down through the fabric. Once the thread is picked, grabbed and trimmed, the thread color can be changed, which is accomplished by actuating the color change motor 96. The color change motor 96 is controlled by color change electronics 100 that are controlled by the electronics 30.

The electronics 30 also act to allow communications between the controller unit 34 and the first embroidery head 28*a*. The second embroidery head 28*b* is connected in series with the first embroidery head 28*a*, and the third embroidery head 28*c* is connected to the second 28*b*, and so on with the nth embroidery head connected to the n−1 embroidery head. Thus, the embroidery heads are connected in a daisy chain type configuration to the electronics 30, and through to the controller unit 34.

Occasionally, the pattern that is being embroidered requires that a long stitch be made, and often the rack cannot move into position fast enough to make the stitch the correct length prior to the needle coming down through the fabric. To handle this operation, the jump stitch motor 104 associated with the particular embroidery head 28 performing the jump stitch operation is utilized. The jump stitch motor 104, when actuated, allows the needle to stay up through the stitch. Generally, a jump stitch is required when stopping the z-axis motor 56 at headup or to move to a new area for embroidery that is greater than about 12.7 mm distance from the previous stitch.

Each of the embroidery heads 28 also has its own and separate take up lever motor 108 and associated take up lever electronics 116, which are utilized in controlling the positions of a take up lever that the take up lever motor 108 is operably connected to. The three positions of the take up lever are enable, disable and color change. The enable position is assumed when the embroidery head is being used to stitch. The disabled position is used when the embroidery head is turned off or when it is in its "stitchback" mode, which mode exists when only the embroidery head with thread break is embroidering. The color change position is assumed when a thread color change is being made.

Each of the embroidery heads 28 preferably has its own thread break printed circuit board (PCB) 150. Each of the thread break PCBs 150*a* . . . 150*n* is involved with a thread break associated with the embroidery head 28*a* . . . 28*n* to which it is dedicated. In one embodiment, each thread break PCB 150 communicates with hardware that can be used in diagnostic procedures. In the case of the stitching machine 20 having a relatively large number of embroidery heads 28, each thread break PCB 150 communicates with a separate one of such hardware devices. In the embodiment of FIG. 1, the thread break PCB 150*a* communicates with start/stop frame switches 154, which are beneficial in operator control of rack movement. The thread break PCB 150*b* communicates with key pads 158 which are useful in stepping or otherwise controlling incremental movements of certain motors, such as the x-axis 42, y-axis 46 and color change 96 motors. The thread break PCB 150*c* communicates with color change sensors 162 that can be employed by the operator to manually read thread color change sensors. The thread break PCB 150*d* communicates with a needle LED display 166 for providing useful information related to needle position or movement. In this embodiment as well, the thread break PCB 150*e* communicates with the second set of start/stop frame switches 170, which are located at an opposite end of the stitching machine 20 from the start/stop frame switches 154 for operator convenience.

The stitching machine computer 24 also includes a display 124 for use in displaying desired stitching operation controls. In one embodiment, the stitching machine computer 24 is also attached to a customer network server 128 via a network connection 132. This customer network server 128 can be networked to other computers, possibly allowing access to the stitching machine computer from a remote location.

During operation, several events may happen which will cause the stitching machine 20 to malfunction. For example, an incompatible application file may receive an invalid command or message from the control panel software. Other electronics errors can occur as well, such as an error within the controller unit 34. Additionally, the motors or the motor electronics within the stitching machine 20 can bind or have some other problem which would cause the motor not to be able to move. Additionally, thread can break, or the rack may be moved to an area such that if the needle came down, it would be outside of the hoop.

With respect to stitching machine operations, particularly those related to providing information related to proper or improper (faulty) operations of the stitching machine 20, a number of initial steps are performed. Assume that a stitching machine 20 is in a powered down state and it is desired to use the machine for embroidery purposes. Accordingly, a BIOS power up operation is conducted and the 188 CPU 44 in the stitching machine control unit 34 is configured. Next, a clear configure out is conducted, a beeper off is made and the motor brake is turned on. Interrupt vectors are loaded up and timers are initialized. Zeroing out steps are performed on the dual port, the first-in first-out (FIFO) and the system random access memory (RAM). There is a wait for the stitching machine application file to be downloaded to the CPU 44. The host computer is involved with starting an operating systems program, such as Microsoft Windows®. The control panel software is also started. The application file anticipated to be compatible with the stitching machine 20 is downloaded to the CPU 44 through the dual port. An application file initialization sequence is conducted. Both design memory and dual port memory are reset or zeroed out.

Figure 2A:
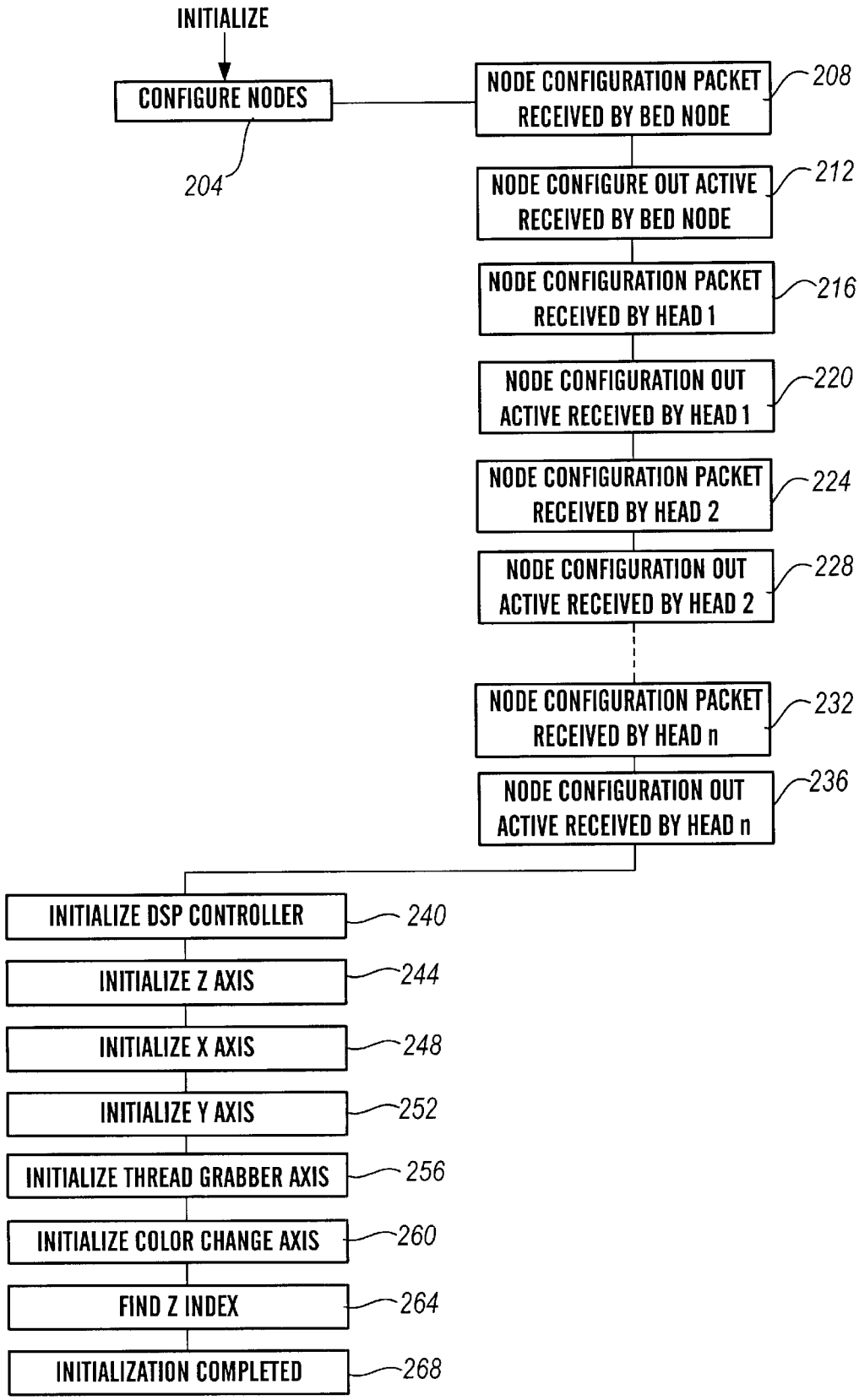
FIGS. 2A–2B are flow diagrams illustrating major steps or procedure s conducted during the diagnostic test and subsequent normal operation of the computerized stitching machine.

Next, a number of configuration and initialization steps are conducted as part of testing and diagnosing the stitching machine 20 before it conducts normal stitching operations using the application file and a desired design file. Referring to FIG. 2A, a number of configuration steps are conducted at block 204. In that regard, a number of sub-steps are performed. At block 208, the CPU 44 sends a node configuration data packet on the CAN bus 32. Pursuant to this node configuration data packet being sent, that node may not properly respond. If so, an error message may be output, such as: No. 57—bed electronics not responding to commands; or No. 64—communications error detected by bed electronics. This bed node can also reply as node 0 with current node status, which might include the following error message if accurate: No. 90—picker motor cannot find home, check for obstructions. Subsequently, at block 212, the CPU 44 sends out a "node configure out active" communication. If no response is received, this can generate the following message: No. 71—bed electronics not responding to configuration command. The bed node, as expected, should reply with an acknowledge as node no. 0 indicating that configuration associated with the bed node is complete and output a message such as: No. 50—bed electronics configured.

At block 216, the CPU 44 next sends a node configuration data packet on the CAN bus 32, which is to be acted on by the next component in the chain. When a fault exists, one of these messages may be output: No. 58—embroidering head 1 electronics not responding to commands; or No. 65—communications error detected by embroidery head 1 electronics. The first embroidery head could also reply as node no. 1 with current node status which, if such exists, could be an output as follows: No. 78—jump stitch motor cannot find home on embroidery head 1; or No. 84—take up lever motor cannot find home on embroidery head 1. At block 220, the CPU 44 next sends out a node configure out active communication. When no response thereto is generated, the following message could be provided: No. 72—embroidery head 1 electronics not responding to configuration command. However, the first embroidery head is expected to reply with an acknowledge as node no. 1 indicating that the configuration is complete and embroidery head 1 electronics are properly configured.

At block 224, the CPU 44 again sends a node configuration data packet on the CAN bus 32. If there is no response, at this time by embroidery head 2, an output can be provided, namely: No. 59—embroidery head 2 electronics not responding to commands. If bad data is received, the following message can be provided: No. 66—communications error detected by embroidery head 2 electronics. The embroidery head 2 or second head node can also reply with current node status including the following, when present: No. 79—jump stitch motor cannot find home on embroidery head 2; or No. 85—take up lever motor cannot find home on embroidery head 2. At block 228, the CPU 44 then sends a node configure out active communication. If there is no response, the following output can be generated: No. 73—embroidery head 2 electronics not responding to configuration command. If the second embroidery head node replies with an acknowledge, then the configuration is complete for embroidery head 2 and an output, such as: No. 52—embroidery head 2 electronics configured, can be provided.

The CPU 44 continues to send node configuration data packets to each of the remaining embroidery head nodes, until head n node is accessed at block 232. Similarly, it sends the same node configure out active communication to each embroidery head, until it finishes with head n node. Outputs like that generated in connection with embroidery heads 1 and 2 can be provided, depending on the results of the communication.

Upon completion of each of the sub-operations or sub-steps 208–236 associated with the configure nodes procedures beginning at block 204, further steps are performed related to normal stitching machine operation. At block 240, the controller unit 34 is initialized to ensure that it can properly communicate. If no response occurs to that communication, an output is provided, such as: No. 32—serious DSP 50 error, CPU 44 halted and stitching machine power is to be cycled. At block 244, the z-axis motor 56 is initialized. If no response to this communication occurs, an error message is provided: No. 32—serious DSP error, CPU 40 halted, stitching machine power is to be cycled. On the other hand, if the initialization was proper, an output can be provided, such as: No. 101—z-axis initialized successfully. At blocks 248, 252 similar initializations are conducted with the x-axis motor 42 and the y-axis motor 46, respectively. If no response occurs, an error output can be provided, which can be same as that provided when there is no response in conducting the initialization of the z-axis motor. Status upon completion of such initializations can also provide an output indicating that these components were initialized successfully. At block 256, an initialization is conducted involving the thread grabber motor 64 to a home position. If there is no response, the following error message can be output: No. 32—serious DSP 50 error, CPU 44 halted, machine power is to be cycled. The error message might also include, if one or more exist: No. 31—emergency stop button engaged, release button when safe; No. 35—thread grabber motor driver fault; and No. 26—thread grabber is binding, check for obstructions. If initialization is satisfactory, the following message can be provided: No. 99—thread grabber axis initialized successfully. At block 260, an initialization involving the color change motor 96 is performed. If there is no response to this communication, an error message can be output, namely: No. 32—serious DSP 50 error, CPU 44 halted and the stitching machine power is cycled. With respect to the color change axis index (home position) associated with this motor, status or error messages might result, when present, namely: No. 31—emergency stop button engaged, the button can be released when safe; No. 30—color change motor driver fault, when the fault cannot be cleared; and No. 41—color change motor is stalled and operator action is required, when the color change axis index cannot be found. On the other hand, a successful initialization can provide the output: No. 100—color change axis initialized.

At block 264, a communication is conducted related to finding the z-index (headup). Depending on the presence of such a condition, the following status or error messages can be generated: No. 31—emergency stop button engaged, the button can be released when safe; No. 29—z-axis motor driver fault; and No. 10—z-axis motor is not running, check for obstructions, when the z-axis motor index cannot be found.

Lastly, if the foregoing initialization and/or configuration procedures are successfully completed, at block 268, a status message can be output, namely: No. 1—machine initialized properly, ready for operation and/or No. 22—machine memory cleared, factory default setting restored and machine ready for operation.

Figure 2B:
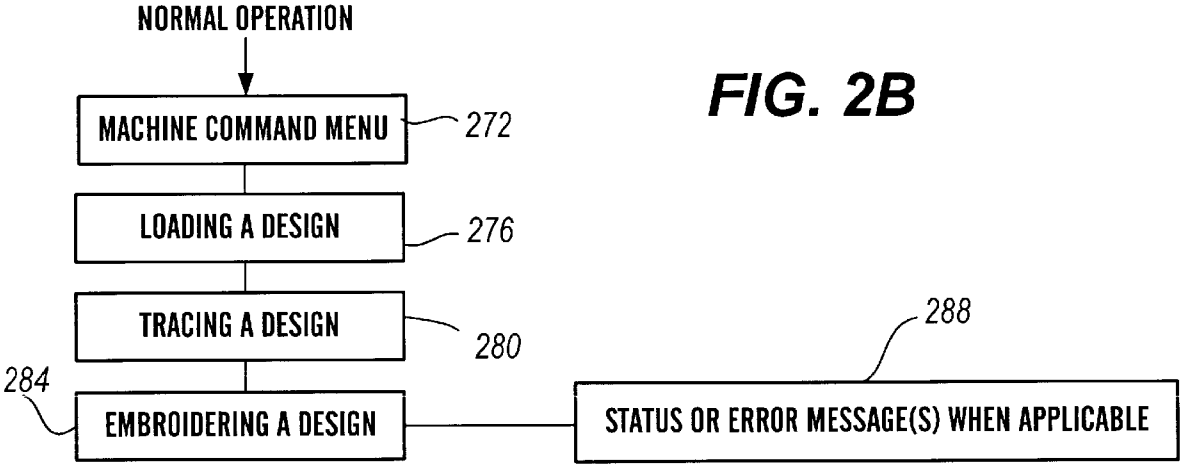

The stitching machine 20 can now be normally operated in the context of performing a desired stitching job. As part of normal operation and with reference to FIG. 2B, status or error messages are generated related to certain stitching machine functions. At block 272, a menu of machine commands are invoked and utilized which may result in an error or status message depending on what occurs. Such messages include:

2—incompatible application file received and invalid x or y seek home command;

4—incompatible application file received and invalid thread grabber message;

7—incompatible application file received and invalid type 3 (general) command;

8—incompatible application file received and invalid head timing command;

19—thread trimmer command disabled in setting menu, thread trimmer not available;

38—rack not moving in x-direction or home detector is broken; and

39—rack not moving in y-direction or home detector broken.

Also part of normal stitching machine operation is loading a design or pattern to be stitched at block 276. Certain error status messages can be output when a fault is present, namely:

6—incompatible application file received and invalid type 2 (related to design) command;

38—rack is not moving in the x-direction or home detector is broken; and

39—rack is not moving in the y-direction or home detector is broken.

Additionally, at block 280, the design is traced in connection with checking for proper operation of the hoop member holding the fabric to be stitched. In particular, the following error message can be output: 11—hoop limit detected, needle will hit hoop and the design must be repositioned to fit in the current frame.

At block 284, stitching machine procedures are conducted for embroidering the desired design. Accordingly, the design is loaded, the color sequence is added, the hoop member selected and the start key pressed. If this is the first design embroidered since the stitching machine 20 was powered up, it will set x and y home positions. During the stitching to form the desired design or pattern, a number of status and a number of error messages can be output, if such a condition or conditions exist, as noted at block 288. Such information can be used by the operator in connection with correcting the condition or remedying the fault. The status and error messages are:

Status Messages

11—hoop limit detected, needle will hit hoop, reposition design to fit in current frame;

13—upper thread break detected, operator action is required;

17—embroidering complete, end of design;

20—outside of hoop, use manual jog keys to move back into embroidery area;

21—pausing after needle/color change, press start key to continue;

23—learn needle/color change, enter new needle and press start;

25—select design from menu before trying to embroider;

31—emergency stop button engaged, release button when safe;

36—stitch length greater than operator preference trim on stitch length;

42—lower thread break detected, operator action is required; and

44—apply applique and press start.

Error Messages

5—operator must set thread grabber home from controller menu to continue;

9—stopped between needles/colors, move color change manually until needles are on a single color;

12—controller missed Z headup index pulse;
15—trimmer home position error, put trimmer to home manually;
16—z motor is binding, check for obstructions;
18—needle not up, operator must perform headup in service menu to continue;
26—thread grabber is binding, check for obstructions;
27—rack is binding in either x or y direction, check for obstructions;
29—z motor drive fault;
30—color change motor driver fault;
32—serious DSP error, CPU halted, cycle machine power;
33—y motor driver fault;
35—thread grabber motor driver fault;
37—x motor driver fault;
46—80188 ES segment register is corrupt;
48—picker is not retracted, check for obstructions;
91—automatically resynchronizing takeup lever on embroidery head 1 to disable position;
92-96—same for heads 2–6;
102—automatically resynchronizing takeup lever on embroidery head 1 to enable position;
103–107—same for heads 2–6;
108—needle position sensor error.

Figure 3A:
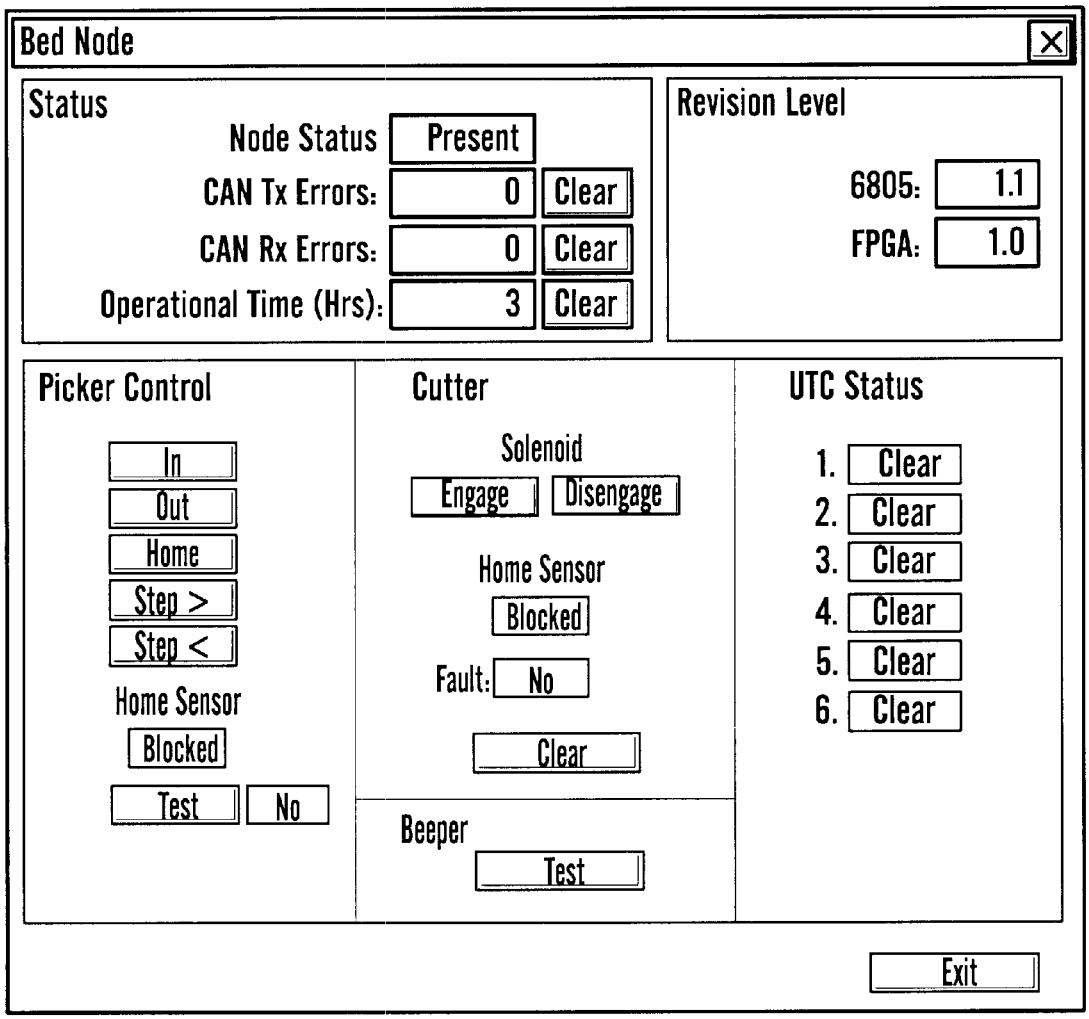
FIGS. 3A through 3C are display screen shots of troubleshooting control software.
Figure 3B:
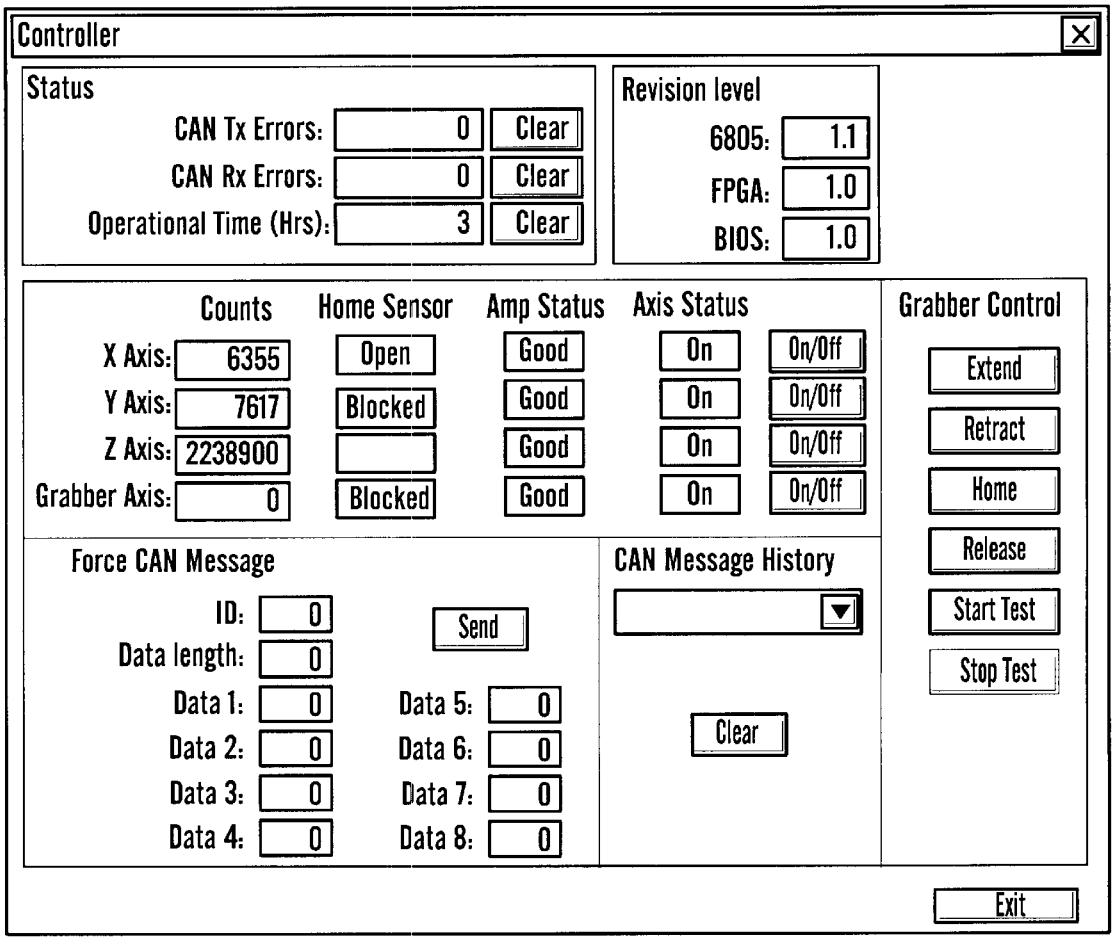
Figure 3C:
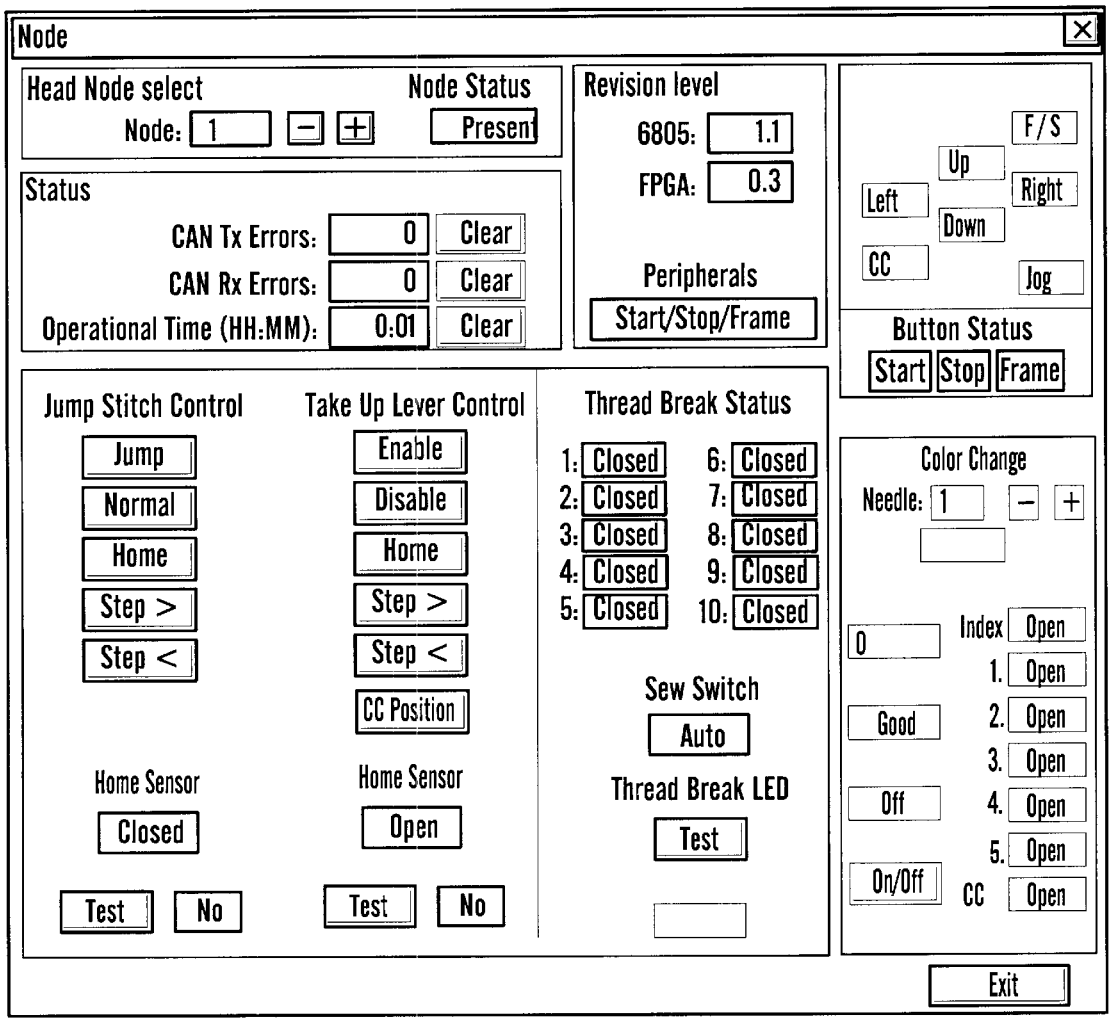

Referring now to FIGS. 3A through 3C, one embodiment of a troubleshooting program screen display is shown. Once an error message is received, a technician can look at the error message and determine the area in which the problem occurred. For example, if the x-axis motor 42 failed to reach the home position during the start up of the stitching machine 20, an error describing this error would be displayed. The technician, recognizing this, can inspect the x-axis motor 42 for any obstructions or electronic problem. After making any needed adjustments, the technician can then start up a troubleshooting program, which will allow him/her to manually actuate the x-axis motor 42. This can be accomplished through troubleshooting software, having screen shots displayed in FIGS. 3A–3C. Referring specifically to FIG. 3A, a screen shot for the troubleshooting program is shown for manually controlling electronics controlled by the electronics 30. This screen would allow a technician to verify that the node is present, meaning that communications are established, whether or not there have been any communications errors and the number of hours the machine has been operational. The screen also displays software revision levels, which may be used to help diagnose incompatible application file or design file errors. The technician can also manually actuate the picker motor 84 and the cutter solenoid 88 to verify that they are in fact operating without having to load a design file or reboot the machine. Additionally, the screen also displays the present status of the under thread control electronics 92.

Referring now to FIG. 3B, the troubleshooting screen for the controller will now be described in detail. The technician can once again verify that there have been no communications errors and operational time, as well as revision levels of loaded programming. The screen also displays status information regarding encoder counts for each motor, the status of the home sensor for each motor, the amp status of each motor, to verify that the motor is drawing an acceptable amount of current from the motor electronics. Additionally, the technician can also manually turn off the power to the x-axis motor 42, the y-axis motor 46, the z-axis motor 56 and the grabber motor 64. With the power to the motor turned off, the motor can be turned manually in order to verify that the encoder counts change or that the home flag is recognized when it passes the home sensor. Additionally, a technician may be able to send specific control messages over the CAN bus 32 and/or motor cable 38 in an advanced troubleshooting situation.

Referring now to FIG. 3C, the troubleshooting screen for the embroidery heads will be described. In one embodiment, the stitching machine 20 has six embroidery heads. Each of the embroidery heads are connected in series, with the first one connecting to the electronics 30, and the other ones behind it in a daisy chain type of configuration. The embroidery head troubleshooting screen allows a technician to select which embroidery head to control, and allows for verification that the node is present. Like the other screens, this screen indicates the communications status and programming revision. The technician can also manually actuate the jump stitch motor 104 and the take up lever motor 108. Additionally, the screen displays thread break status. This diagnostic screen also allows for diagnosing and troubleshooting problems related to the start/stop frame switches 154, 170 and the key paid switches 158. This diagnostic screen can be used to verify that these switches are operating correctly by indicating when one of them has been depressed.

Figure 4:
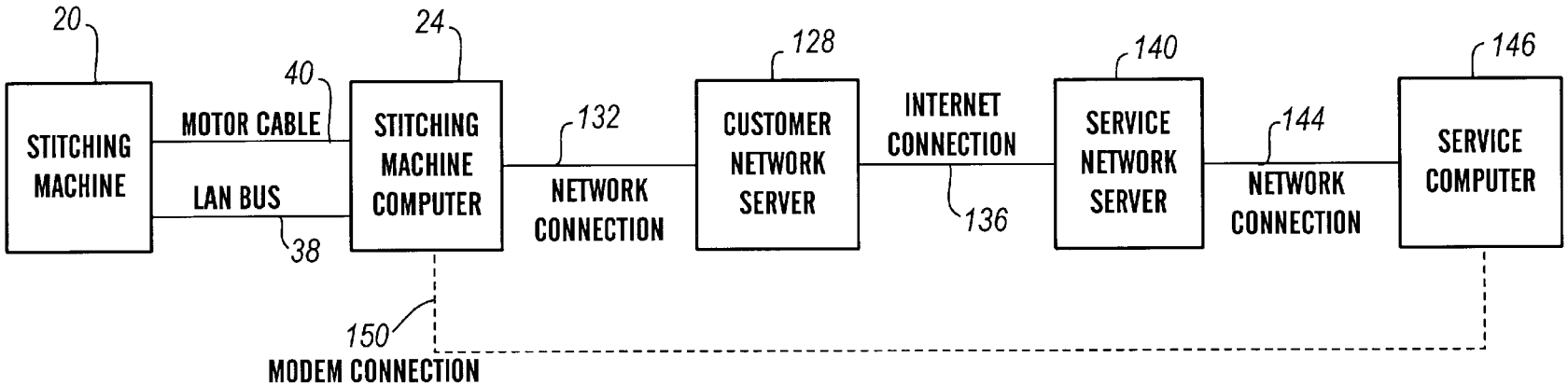
FIG. 4 is a block diagram of a computerized stitching machine showing a connection between the stitching machine computer and a remote service center computer.

Referring now to FIG. 4, the stitching machine computer 24 can also be connected to a remote service computer 146. As shown in FIG. 4, in one embodiment, the stitching machine computer 24 is connected to a customer network server 128 through a network connection 132. The customer network server 128 can then establish an Internet connection 136 to a service network server 140, which is in turn connected to a service computer 146 via a network connection 144. In this embodiment, the service computer 146 can be connected to the stitching machine computer 24. Error messages can be read and basic troubleshooting completed without requiring a technician to go out to the field location and repair the stitching machine 20.

Additionally, the diagnostic screens shown in FIGS. 3A through 3C may be viewed on the service computer, allowing the technician to remotely view the screens and give additional insight into a potential problem and solution, thereby further reducing the need for a technician to make a trip to the machine and make a physical repair. In one embodiment the diagnostic screens may be viewed on the service computer 146 using commercially available networking software, such as NetMeeting™ software from Microsoft or pcAnywhere™ software from Symantec, which is installed and operating on both the stitching machine computer 24 and the service computer 146. This networking software allows both computers to run the diagnostic software and to display the screens. The service computer 146 may remotely control the displays which are automatically updated via the network connection to be displayed at the customer's stitching machine computer 24 using the computer screen display 124. This allows both the user on the service computer 146, and the customer using the stitching machine computer 24, to view the diagnostic screens as they are updated via the network connection. Additionally, in one embodiment, the stitching machine computer 24 may connect to the service computer 146 via a direct modem connection 150, rather than through an Internet connection 136, as shown in FIG. 4. Both embodiments may use voice, such as telephone discussion or voice over the Internet, in conjunction with the remote viewing of screens allowing a remote technician to give verbal instructions to an operator at the stitching machine 20 which may help to resolve any problems.

It will be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A method for obtaining stitching machine information, comprising:

performing a first set of operational procedures including a first operational procedure related to components of said stitching machine including at least a first component thereof, performing a second set of operational procedures that includes providing an application file to a processor from a host computer and checking compatibility of said application file, said second set of operational procedures including providing a design file to be stitched using said host computer and checking compatibility between said application file and said design file;

determining operational information related to said step of performing said first set of operational procedures; and outputting at least a first message that includes information related to whether a fault exists associated with said first component and, when a fault exists associated with said first component, providing an indication thereof.

2. A method for obtaining stitching machine information, comprising:

performing a first set of operational procedures including a first operational procedure related to components of said stitching machine including at least a first component thereof, said components of said stitching machine including: an x-axis motor, a y-axis motor, a z-axis motor, a picker motor, a grabber motor, a color change motor, a hoop member and a thread detector and in which said performing step includes performing a second set of operational procedures, said second set of operational procedures including a plurality of the following: monitoring proper operation of said x-axis motor, monitoring proper operation of said y-axis motor, monitoring timing associated with said z-axis motor, monitoring proper operation of said picker motor, monitoring proper operation of said grabber motor, monitoring a position associated with said color change motor, monitoring at least one limit associated with said hoop member, and monitoring thread break using said thread detector;

determining operational information related to said performing step; and outputting at least a first message that includes information related to whether a fault exists associated with said first component and, when a fault exists associated with said first component, providing an indication thereof.

3. A method, as claimed in claim 2, wherein:

said stitching machine communicates with a controller unit and said controller unit includes at least one processor and said second set of operational procedures includes checking said at least one processor for proper operation.

4. A system for obtaining information from a stitching machine, comprising:

stitching machine components including a plurality of the following: stitching machine electronics, x-axis motor, y-axis motor, z-axis motor, picker motor, grabber motor, trimmer motor, jump stitch motor, take up lever motor, color change motor, thread detector and hoop member;

memory that stores at least one set of operational procedures that includes configuring said stitching machine electronics and checking predetermined positions for a number of the following: said x-axis motor, said y-axis motor, said z-axis motor, said picker motor, said grabber motor, said trimmer motor, said jump stitch motor, said take up level motor and said color change motor;

at least one processor in operative communication with said memory for use in implementing said at least one set of operational procedures; and a first computer display located at a first site having said stitching machine components, said first computer display displaying a status output related to a predetermined position of each of said x-axis motor, said y-axis motor and said z-axis motor;

wherein a status message is output related to whether a fault exists associated with at least one of said stitching machine components, said status message being output using said first computer display.

5. A method for remotely diagnosing a stitching machine, comprising:

providing a customer network in communication with a stitching machine computer that controls a stitching machine;

providing a service network in communication with a service computer;

establishing a communications connection between said customer network and said service network by means of a communications network;

executing diagnostic software by said service computer;

communicating with said stitching machine computer related to said diagnostic software using said customer network, said service network and said communications network;

controlling said stitching machine computer based on said executing step; and diagnosing by a technician said stitching machine using said service computer and said diagnostic software.

6. A method, as claimed in claim 5, wherein:

said controlling step includes running said diagnostic software using said stitching machine computer.

7. A method, as claimed in claim 5, wherein:

said controlling step includes controlling a computer screen display in communication with said stitching machine computer.

8. A method, as claimed in claim 7, wherein:

said executing step includes displaying on a computer screen in communication with said service computer said computer screen display in communication with said stitching machine computer.

9. A method, as claimed in claim 5, wherein:

said executing step includes displaying diagnostic related information using a computer screen in communication with said service computer and said communicating step includes providing said diagnostic related information to said stitching machine computer.

10. A method, as claimed in claim 5, wherein:

said diagnosing step includes causing manual operation of at least a first motor of said stitching machine.

11. A method, as claimed in claim 5, wherein:

said executing step is performed after a fault is determined to exist associated with at least a first component of said stitching machine and said executing step includes directing a troubleshooting procedure using said diagnostic software being executed by said service computer related to said fault.

12. A method, as claimed in claim 11, wherein:

said first fault relates to one of detecting an upper thread break; detecting a lower thread break; detecting a rack of said stitching machine not moving in a x-direction; detecting said rack not moving in a y-direction; and detecting that a picker of said stitching machine is not retracted.

13. A method, as claimed in claim 5, wherein:

said customer network includes a customer network server, said service network includes a service network server and said communications network includes the Internet.

14. A system for remotely diagnosing a stitching machine, comprising:

a stitching machine having a number of components for stitching on a stitching material;

a stitching machine computer in communication with said stitching machine;

a customer network in communication with said stitching machine computer;

a service computer located remotely from said stitching machine and said stitching machine computer;

a service network in communication with said service computer;

a communications network for establishing a communications connection between said customer and service networks;

wherein said service computer includes at least one processor that executes diagnostic software and a computer screen that displays diagnostic related information, said customer network receiving said diagnostic related information from said service network using said communications network and in which said diagnostic related information displayed on said computer screen of said service computer is used by a technician operating said service computer to diagnose at least one fault associated with at least one component of said stitching machine.

15. A system, as claimed in claim 14, wherein:

said customer network includes a customer network server, said service network includes a service network server and said communications network includes the Internet.

16. A system, as claimed in claim 14, wherein:

said at least one fault relates to one of an upper thread break; a lower thread break; a rack not moving in a x-direction; said rack not moving in a y-direction; and a picker failing to retract.

17. A system, as claimed in claim 14, wherein:

said stitching machine computer has a computer screen that displays said diagnostic related information from said service computer.

18. A system, as claimed in claim 14, wherein:

said at least one component includes at least a first motor that is manually activated using a part of said diagnostic related information displayed from said service computer screen.

19. A system, as claimed in claim 14, wherein:

said service computer screen displays at some time a control related to a picker of said stitching machine, a control related to at least a first motor of said stitching machine, a control related to selection of at least one stitching machine head and a control related to verifying operation of frame switches and keypad switches of said stitching machine.

20. A method for remotely diagnosing a stitching machine, comprising:

providing a stitching machine having a number of components in communication with a stitching machine computer;

monitoring at least a number of said plurality of components including:

monitoring whether a break occurs in upper thread of said stitching machine;

monitoring whether a break occurs in lower thread of said stitching machine;

monitoring whether a rack used to move said hoop is moving in a x-direction;

monitoring whether said rack is moving in a y-direction; and monitoring retraction of a picker of said stitching machine;

diagnosing remotely said stitching machine using a service computer that is in communication with said stitching machine computer using the Internet when at least a first fault occurs related to at least one of said rack, said upper thread, said lower thread and said picker.

21. A method, as claimed in claim 20, wherein:

said diagnosing step includes displaying diagnostic related information using a computer screen of said service computer and controlling said stitching machine using said diagnostic related information.

22. A method, as claimed in claim 20, wherein:

said stitching machine computer is in communication with a computer screen that displays said diagnostic related information.

23. A method, as claimed in claim 21, wherein:

said diagnostic related information includes information related to at least one motor for moving said rack.

* * * * *